US012599274B2

(12) United States Patent
Perlman

(10) Patent No.: US 12,599,274 B2
(45) Date of Patent: Apr. 14, 2026

(54) PORTABLE URINAL FOR USE WITH PATIENTS WITH LIMITED MOBILITY

(71) Applicant: David Perlman, Philadelphia, PA (US)

(72) Inventor: David Perlman, Philadelphia, PA (US)

( * ) Notice: Subject to any disclaimer, the term of this patent is extended or adjusted under 35 U.S.C. 154(b) by 88 days.

(21) Appl. No.: 18/514,552

(22) Filed: Nov. 20, 2023

(65) Prior Publication Data

US 2024/0164597 A1 May 23, 2024

Related U.S. Application Data

(60) Provisional application No. 63/426,628, filed on Nov. 18, 2022.

(51) Int. Cl.
*A47K 11/12* (2006.01)
*A47K 11/02* (2006.01)

(52) U.S. Cl.
CPC ..... *A47K 11/12* (2013.01); *A47K 11/02* (2013.01)

(58) Field of Classification Search
CPC ..... A47K 11/12
See application file for complete search history.

(56) References Cited

U.S. PATENT DOCUMENTS

| | | | | |
|---|---|---|---|---|
| 345,890 | A * | 7/1886 | Farson | A47K 11/04 4/420.3 |
| 4,030,145 | A * | 6/1977 | Rowan | E03D 11/025 4/300 |
| 7,562,400 | B2 * | 7/2009 | Graham | A47K 11/04 4/480 |
| 8,561,219 | B2 | 10/2013 | Metcalf et al. | |
| 8,800,074 | B2 | 8/2014 | Rodgers et al. | |
| 9,702,483 | B2 * | 7/2017 | Carver | F16L 3/1075 |
| 10,724,259 | B2 | 7/2020 | Schimmel | |
| 10,743,728 | B2 | 8/2020 | Nelson | |
| 11,089,912 | B2 | 8/2021 | Talada et al. | |
| 2020/0102731 | A1 | 4/2020 | Gochko et al. | |
| 2020/0113395 | A1 | 4/2020 | Buck | |
| 2021/0246645 | A1 * | 8/2021 | Rodgers | A47K 17/026 |
| 2023/0337873 | A1 * | 10/2023 | Purcell | A47K 11/12 |

* cited by examiner

*Primary Examiner* — Christine J Skubinna
(74) *Attorney, Agent, or Firm* — Volpe Koenig

(57) ABSTRACT

A portable urinal for use by people having limited mobility is disclosed. The portable urinal comprising a cabinet and a vessel. The cabinet having a base, a top wall, a rear wall, an openable and closeable door offset from the rear wall, and sidewalls extending from the base to the top wall and between the rear wall and the door. The vessel is located within the cabinet, and the vessel is configured to receive urine from a user. In addition, the vessel is removeable from the cabinet to facilitate disposal of the urine within the vessel.

3 Claims, 3 Drawing Sheets

PORTABLE URINAL FOR USE WITH PATIENTS WITH LIMITED MOBILITY

CROSS REFERENCE TO RELATED APPLICATIONS

This application claims the benefit of U.S. Provisional Patent Application No. 63/426,628 filed on Nov. 18, 2022, which is incorporated by reference as if fully set forth.

TECHNICAL FIELD

The present disclosure is directed to a portable urinal, and more particularly it is directed to a portable urinal for use with patients or users with limited mobility.

BACKGROUND OF THE INVENTION

People with pain or limited mobility often have issues and/or difficulty using the bathroom. Specifically, people with pain or limited mobility often have a difficult time standing up from their bed or chair and walking to the bathroom. The aforementioned is an issue during both the daytime and the nighttime for people of old age, people with medical issues, and/or people with limited mobility. The current solution for this problem is to have another person (i.e., nurse, aid, friend, family member, etc.) help the limited mobility person stand up from their bed or chair and walk to the bathroom. If another person is not around to help, an alternative is to utilize a handheld container or device for urinating in and then disposing of at a later time. The issue with the handheld container or device is that it can be messy and difficult to handle for users having pain or limited mobility.

As such, there is a need for a new solution that allows a person with pain or limited mobility to urinate without having to walk to the bathroom.

SUMMARY OF THE INVENTION

According to one aspect, a personal urinal closet or cabinet is disclosed. The personal urinal closet or cabinet can include a box with a door and a large basin/waterless urinal that slides out from the closet or cabinet. The large basin/waterless urinal may be configured to store urine, or the large basin/waterless urinal may be configured to direct urine into a separate container that stores the urine. The basin/urinal may be secured or removably attached directly to the box. The basin/urinal may be connected to the box with hinges. Alternatively, the basin/urinal may be attached to a shelf that is slidably connected to rails or tracks in the urinal closet or cabinet. There may be multiple rails, shelves, and/or basins at various heights, or the shelf and basin may have an adjustable height. The personal urinal closet or cabinet is designed to be near a bed or chair so that someone struggling to get up and walk to the restroom can urinate in the personal urinal closet or cabinet. The height adjustment feature of the basin/waterless urinal allows someone to urinate standing up or sitting on a bed/chair.

Some additional features of the personal urinal closet or cabinet may include a base and a grab bar to help support the user while standing up from the bed and remain supported while using the personal urinal closet or cabinet. The base may be secured to the floor for stability or the base may include a container that can be filled with a material such as water or sand to stabilize the box. Grab bars may be located on the side and/or top of the box. The basin/waterless urinal may comprise a bowl with a wall extending up from the bowl. The wall attached to the bowl may be at an angle to direct urine into the bowl and eliminate or limit splash. In addition, some embodiments of the invention may be used by females.

BRIEF DESCRIPTION OF THE DRAWINGS

The foregoing Summary as well as the following Detailed Description will be best understood when read in conjunction with the appended drawings, which illustrate a preferred embodiment of the disclosure. In the drawings.

DETAILED DESCRIPTION OF THE PREFERRED EMBODIMENTS

Figure 1:
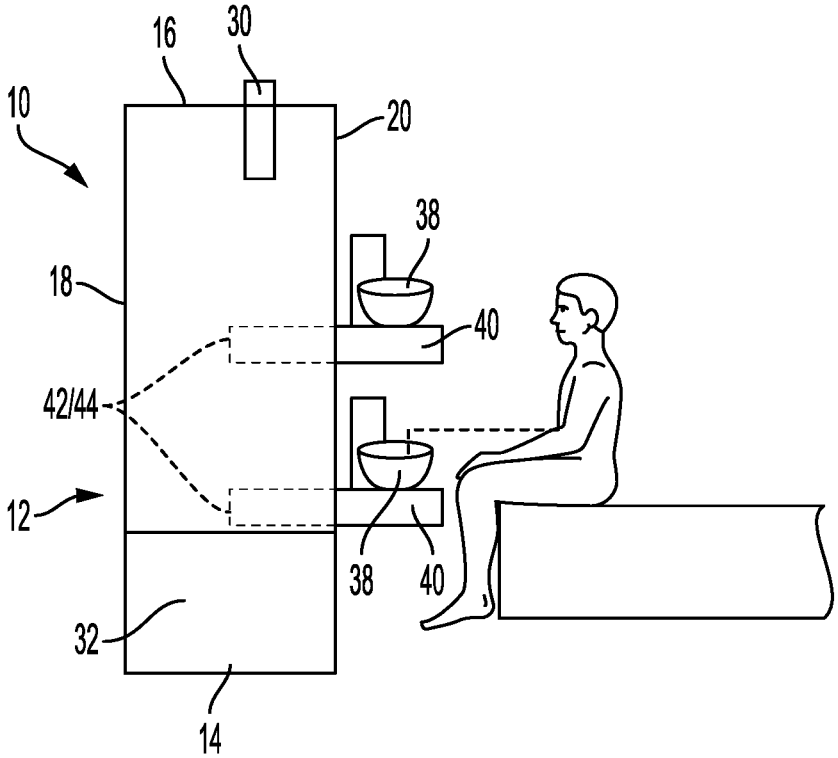
FIG. 1 is a perspective view of a portable urinal according to the present invention.

Certain terminology is used in the following description for convenience only and is not limiting. The words "front", "rear", "upper", and "lower" designate directions in the drawings to which reference is made. The words "inwardly" and "outwardly" refer to directions towards and away from parts referenced in the drawings. "Axially" refers to a direction along the axis of an axle, shaft, pin, or the like. A reference to a list of items that are cited as "at least one of a, b, or c" (where a, b, and c represent the items being listed) means any single one of the items a, b, or c, or combinations thereof are included. The terms "about" and "approximately" encompass +/−10% of an indicated value unless otherwise noted. The term "generally" in connection with a radial direction encompasses +/−25 degrees. The terminology includes the words specifically noted above, derivatives thereof and words of similar import.

Figure 2:
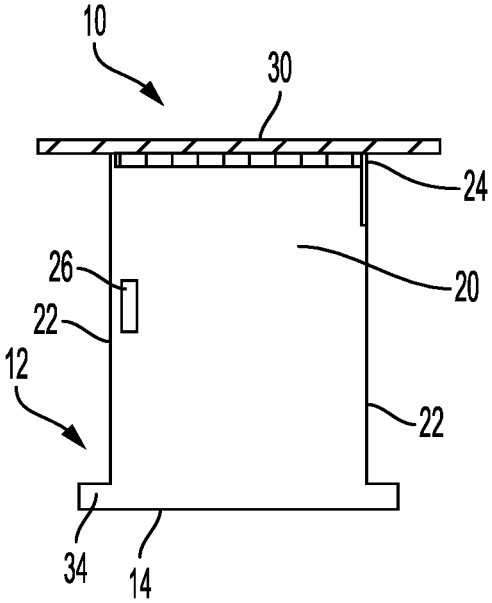
FIG. 2 is a front view of the portable urinal of FIG. 1.
Figure 3:
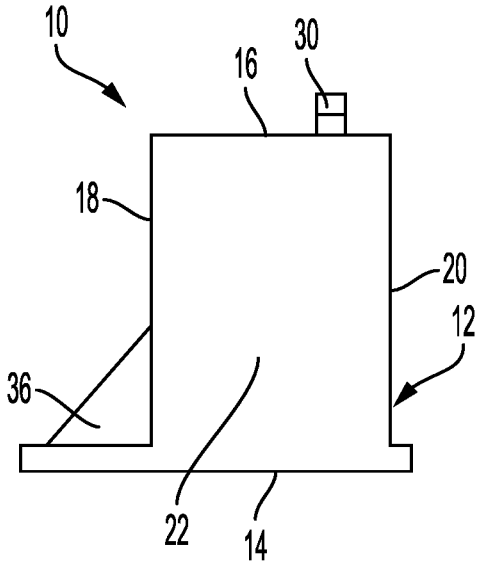
FIG. 3 is a side view of the portable urinal of FIG. 1.
Figure 4:
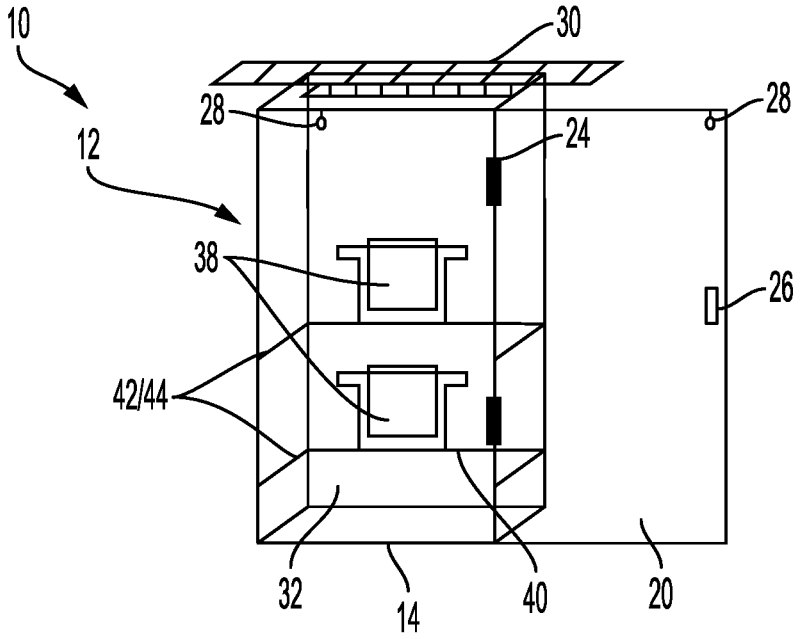
FIG. 4 is a perspective front view of the portable urinal of FIG. 1.
Figure 5:
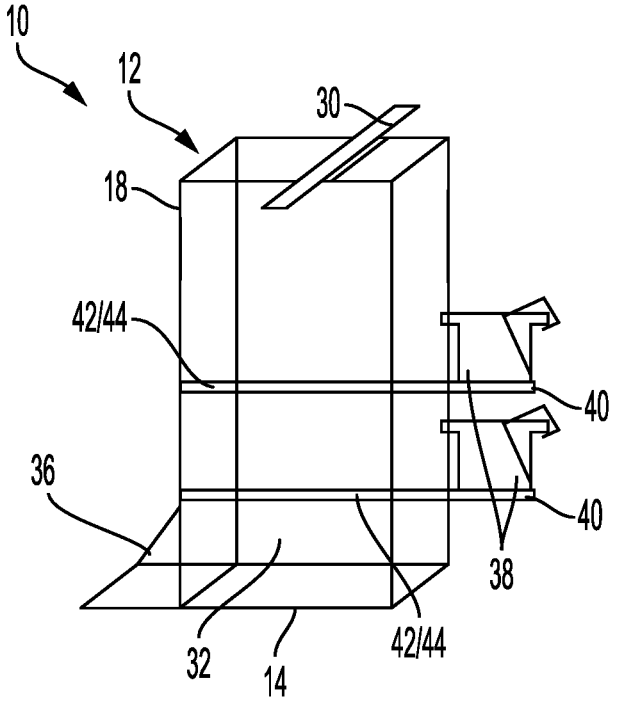
FIG. 5 is a perspective side view of the portable urinal of FIG. 1.

FIG. 1 is a perspective view of a portable urinal 10 according to the present invention. FIG. 2 is a front view of the portable urinal 10. FIG. 3 is a side view of the portable urinal 10. FIG. 4 is a perspective front view of the portable urinal 10. FIG. 5 is a perspective side view of the portable urinal 10. FIGS. 1-5 will be discussed together. The purpose of the portable urinal 10 is to allow a person with pain or limited mobility to urinate without having to walk to the bathroom or use a messy plastic urinal in bed. When using the portable urinal 10, the user can either stand and hold the grab bar 30, or sit on the edge of the bed. The portable urinal 10 includes at least one shelf 40 that slide out so the vessel 38 with the non-splash attachment 46 can be moved closer to the user. The portable urinal 10 makes it easier for user's with pain or limited mobility to urinate from their bed or chair, with limited effort and inconvenience for the user. The portable urinal 10 will be discussed in detail below with reference to the drawings, which illustrate preferred embodiments.

The portable urinal 10 includes a cabinet 12 having a base 14, a top wall 16, a rear wall 18, a door 20, and sidewalls 22. The base 14 is the wall or surface that is positioned adjacent a floor or other supporting surface upon which the portable urinal 10 is supported. The top wall 16 is the uppermost wall or surface of the cabinet 12, and the top wall 16 is offset from the base 14. In some embodiments, the top wall 16 can be positioned parallel with the base 14. The rear wall 18 is the rear-most wall or surface when the portable urinal 10 is in use. The rear wall 18 is coupled to and extends between the base 14 and the top wall 16. The door 20 is the front-most wall or surface when the portable urinal 10 is in use. The door 20 is coupled to and extends between the base 14 and the top wall 16. In some embodiments, the door 20 can be offset from and parallel with the rear wall 18. The sidewalls 22 are the side walls or surfaces of the cabinet 12 when the portable urinal 10 is in use. The sidewalls 22 extend vertically between and are coupled to the base 14 and the top wall 16. Further, the sidewalls 22 extend horizontally between and are coupled to the rear wall 18 and the door 20.

In the illustrated embodiment, the cabinet 12 includes generally the shape of a rectangular prism. As such, each of the base 14, top wall 16, rear wall 18, door 20, and sidewalls 22 are generally rectangular shaped walls or surfaces. In some embodiments, the cabinet 12 can be constructed from wood or a polymeric material, among other options not specifically listed. The door 20 is coupled to at least one of the sidewalls 22, and the door 20 is openable and closeable relative to the other walls of the cabinet 12. Specifically, the door 20 includes at least one hinge 24 that is coupled to the door 20, and the at least one hinge 24 is also coupled to one of the sidewalls 22. The at least one hinge 24 is configured to facilitate a rotation or swinging movement of the door 20 relative to the other walls of the cabinet 12, facilitating the opening and closing of the door 20. The door 20 can include a handle 26 positioned on an exterior surface of the door 20, the handle 26 is a component in which a user can grasp and pull or push to open or close, respectively, the door 20.

Further, the door 20 can include a latch 28 positioned on and coupled to an interior surface of the door 20. The latch 28 is configured to secure the door 20 in a closed position, preventing the door 20 from freely swinging into the open position. In some embodiments, the latch 28 can be a magnet that is configured to couple to another magnetically attractable component secured to an inner surface of the sidewalls 22 or the top wall 16. In other embodiments, the latch 28 can be a hook that is configured to engage with a pin or other feature secured to an inner surface of the sidewalls 22 or the top wall 16. In other embodiments, the latch 28 can be any component that is capable of securing the door 20 in a closed position, preventing the door 20 from freely swinging into the open position, and a component that releases upon the user pulling the door 20 away from an interior of the cabinet 12.

The cabinet 12 can further include a grab bar 30 coupled to the top wall 16 or the sidewalls 22 of the cabinet 12. The grab bar 30 is a tubular shaped component that is sized and shaped such that a user can easily grasp onto the grab bar 30. The grab bar 30 is configured to aid a user in utilizing the portable urinal 10. Specifically, a user can grasp the grab bar 30 when the user is standing up from a sitting position to help stabilize the user while they stand up. Further, the user can continue to grasp the grab bar 30 while the user is utilizing the portable urinal 10 to further aid in stabilizing the user while they utilize the portable urinal 10. As discussed, in some embodiments, the grab bar 30 is coupled to an exterior surface of the top wall 16, and the grab bar 30 extends away from the top wall 16. In other embodiments, the grab bar 30 can be coupled to exterior surfaces of the sidewalls 22 and the grab bar 30 can extend away from the top wall 16. In addition, the grab bar 30 can extend widthwise such that the grab bar 30 is at least the width of the cabinet 12, specifically the width of the door 20. In addition, the grab bar 30 is positioned closer to the door 20 than the rear wall 18, making it easy for the user to reach up and grasp the grab bar 30, both when standing up and when utilizing the portable urinal 10.

The cabinet 12 further includes a base compartment 32 positioned adjacent the base 14 of the cabinet 12. Specifically, the base compartment 32 is an open cavity that is defined by interior surfaces of each of the base 14, the sidewalls 22, the rear wall 18, and the door 20. The base compartment is positioned near the lower portion of the cabinet 12, specifically adjacent an interior surface of the base 14. The base compartment 32 is configured to provide a space in which a weighted item can be placed to aid in stabilizing and securing the portable urinal 10 in place. More specifically, the base compartment 32 provides a space in which a sand bag, a bucket filled with water, sand or other element, or any other weight element can be placed to ensure the portable urinal 10 does not move or tip over when in use.

In addition, in some embodiments, the base compartment 32 can be utilized to store an additional vessel. In such embodiments, a user can urinate into the vessel 38 and then the urine can flow through a tube or channel to the second or lower vessel positioned within the base compartment 32. Then a user could remove the second or lower vessel to empty the contents of the vessel. Further, instead of placing a weighted item in the base compartment 32, the portable urinal 10 can include at least one bracket 34 coupled to the sidewalls 22 or the base 14 of the cabinet 12. The at least one bracket 34 can be configured to secure the cabinet 12 to a floor or other supporting surface through the use of fasteners. In such an embodiment, a user can permanently secure the portable urinal 10 to the floor using screws or bolts and the at least one bracket 34. As illustrated in FIG. 3, the portable urinal 10 can further include a rear wall support 36 extending between and coupled to each of the rear wall 18 and the base 14. Specifically, the rear wall support 36 can be a member that is coupled to an exterior of the rear wall 18 and an extension portion of the base 14, and the rear wall support 36 can be utilized to add additional stability to the cabinet 12 and the overall portable urinal 10 when in use.

Referring to FIGS. 4-5, the portable urinal 10 can further include a vessel 38 located within the cabinet 12. The vessel 38 is configured to receive urine from a user, and the vessel 38 is removeable from the cabinet 12 to facilitate disposal of the urine within the vessel 38. In some embodiments, as illustrated, the vessel 38 can be coupled to a shelf 40 positioned within the cabinet 12, with the shelf 40 being coupled to the sidewalls 22 of the cabinet 12. More specifically, the shelf 40 can be coupled to a first slide 42 and a second slide 44. The first slide 42 and the second slide 44 can be coupled to opposite sidewalls 22 of the cabinet 12, and the first slide 42 and the second slide 44 are configured to horizontally translate the shelf 40 outward beyond the door 20 of the cabinet 12. As such, the first slide 42 and the second slide 44 can be described as being drawer slides or guides that allow the shelf 40 translate inwards and outwards relative to an interior of the cabinet 12. The shelf 40 being coupled to the first slide 42 and the second slide 44 allows the vessel 38, which is coupled to the shelf 40, to translate inwards and outwards relative to an interior of the cabinet 12. The aforementioned allows the user to pull the vessel 38 outwards through the door 20 from within the cabinet 12, such that the vessel 38 is positioned fully outside the cabinet 12 when in use. This makes it easier for a user to urinate into the vessel 38 when they are either sitting or standing next to the portable urinal 10.

In some embodiments, the portable urinal 10 may include a first shelf 40A and a second shelf 40B, with the first shelf 40A and the second shelf 40B positioned at different heights relative to the base 14. In addition, each of the first shelf 40A and the second shelf 40B can be coupled to a first slide 42 and a second slide 44, with the first slide 42 and the second slide 44 being coupled to opposite sidewalls 22 of the cabinet 12. Further, the portable urinal 10 can include a single vessel 38 or the portable urinal 10 can include two vessels 38. In an embodiment in which the portable urinal 10 includes a single vessel 38, the user can place the vessel 38 on either the first shelf 40A or the second shelf 40B to adjust the height of the vessel 38 to achieve the user's desired height. As such, in such an embodiment, the vessel 38 is configured to be separately coupled to and decoupled from the first shelf 40A and the second shelf 40B. In an embodiment in which the portable urinal 10 includes two vessels 38, a vessel 38 can be placed on each of the first shelf 40A and the second shelf 40B and the user can choose which vessel 38 to utilize based on their desired height.

In use, in some examples, a user can sit on the edge of a bed or chair and the user can grasp and pull on the handle 26 to swing the door 20 about its hinges 24 to open the door 20. Then the user can grasp the shelf 40 of the vessel 38 at the desired height, and the user can pull the shelf 40 or vessel 38 through the door and outwards away from an interior of the cabinet 12. When the user is pulling the shelf 40 of vessel 38 outwards, the shelf 40 translates along the first slide 42 and the second slide 44, providing a smooth and easy sliding movement. Then the user can urinate into the vessel, and once finished, the user can slide the shelf 40 and vessel 38 back into the cabinet 12 and close the door 20 to complete the urination task. As an alternative or additionally, the user can grasp onto the grab bar 30 and stand up from their bed or chair, and the user can hold onto the grab bar 30 for stability while using the portable urinal 10. In this example, after standing the user would perform the same steps of opening the door 20 and pulling out the vessel 38 for use. Lastly, once the vessel 38 is full or the user wishes the dispose of the contents of the vessel 38, the user can remove the vessel 38 from the shelf 40 and the overall cabinet 12 and the user can dispose of the contents in a toilet. In some embodiments, the vessel 38 can contain a hydroscopic substance that absorbs the urine to further facilitate disposal.

Figure 6A:
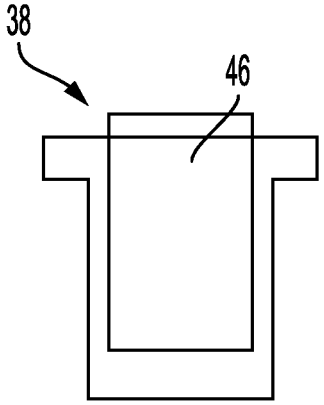
FIG. 6A is a front view of a first embodiment of a vessel used with the portable urinal of FIG. 1.
Figure 6B:
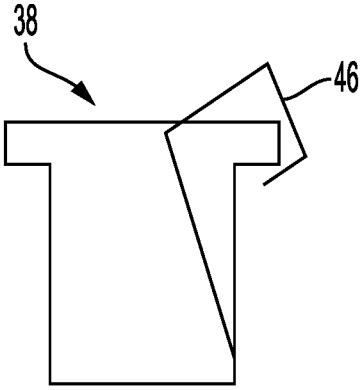
FIG. 6B is a side view of the first embodiment of the vessel of FIG. 6A.

FIG. 6A is a front view of a first embodiment of the vessel 38 used with the portable urinal 10. FIG. 6B is a side view of the first embodiment of the vessel 38. FIGS. 6A-6B will be discussed together. In the embodiment illustrated in FIGS. 6A-6B, the vessel 38 is a bucket that is configured to store a liquid. The bucket can be a square bucket/vessel 38, a circular bucket/vessel 38, or any other shaped bucket/vessel 38. The bucket/vessel 38 can include an open interior and a lip extending around an upper perimeter of the bucket/vessel 38. A non-splash attachment 46 can be coupled to the lip of the bucket/vessel 38. The non-splash attachment 46 is configured to reduce or eliminate splashing during urination. The non-splash attachment 46 can be a thin component with a non-parallel and non-perpendicular angled surface relative to a lower surface of the vessel 38, when the non-splash attachment 46 is attached to the vessel 38. In some embodiments, the non-splash attachment 46 can be a thin polymeric sheet that can be snap-fit onto the lip of the vessel 38. In other embodiments, the non-splash attachment 46 could be construed from a different material, and the non-splash attachment 46 could be coupled to the vessel 38 utilizing other fastening techniques. Although not illustrated, it is to be understood that the vessel 38 can include a seat that is positioned on an upper surface of the vessel 38, such that the vessel 38 is adapted for use by women and/or it allows a user to sit on the vessel 38 if desired.

Figure 7A:
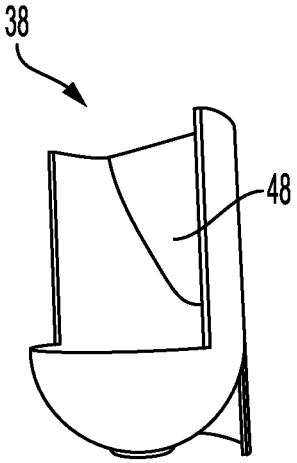
FIG. 7A is a perspective view of a second embodiment of a vessel used with the portable urinal of FIG. 1.
Figure 7B:
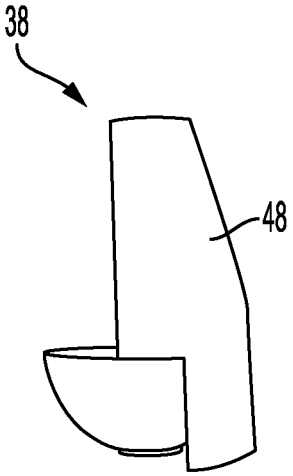
FIG. 7B is a side view of the second embodiment of the vessel of FIG. 7A.

FIG. 7A is a perspective view of a second embodiment of the vessel 38 used with the portable urinal 10. FIG. 7B is a side view of the second embodiment of the vessel 38. FIGS. 7A-7B will be discussed together. In the embodiment illustrated in FIGS. 7A-7B, the vessel 38 is a molded component that includes an open interior cavity and the vessel 38 is configured to be fluid tight and prevent fluid leakage of any sort. Further, in the embodiment illustrated in FIGS. 7A-7B, the vessel 38 includes a bowl-shaped lower portion, an upward extending rear portion, and a non-splash feature 48 directly formed into the second embodiment of the vessel 38. Similar to the first embodiment, the non-splash feature 48 is configured to reduce or eliminate splashing during urination. The non-splash feature 48 can be oriented at a non-parallel and non-perpendicular angle relative to a lower surface of the vessel 38 to prevent splashing during urination. Although a specific shape is illustrated in FIGS. 7A-7B, it is to be understood that the shape can vary but the overall purpose is to hold and store a liquid.

The portable urinal 10 allows a person with pain or limited mobility to urinate without having to walk to the bathroom or use a messy plastic urinal in bed. When using the portable urinal 10, the user can either stand and hold the grab bar 30, or sit on the edge of the bed or chair. The portable urinal 10 includes at least one shelf 40 that slides out so the vessel 38 with the non-splash attachment 46 can be moved closer to the user. The portable urinal 10 makes it easier for user's with pain or limited mobility to urinate from their bed or chair, with limited effort and inconvenience for the user.

Having thus described the present embodiments in detail, it is to be appreciated and will be apparent to those skilled in the art that many physical changes, only a few of which are exemplified in the detailed description of the disclosure, could be made without altering the inventive concepts and principles embodied therein.

It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the disclosure being indicated by the appended claims rather than by the foregoing description, and all alternate embodiments and changes to this embodiment which come within the meaning and range of equivalency of said claims are therefore to be embraced therein.

DISCUSSION OF POSSIBLE EMBODIMENTS

According to one aspect, a portable urinal for use by people having limited mobility is disclosed. The portable urinal can include a cabinet and a vessel. The cabinet can include a base, a top wall, a rear wall, an openable and closeable door offset from the rear wall, and sidewalls extending from the base to the top wall and between the rear wall and the door. The vessel can be located within the cabinet, the vessel can be configured to receive urine from a user, and the vessel can be removeable from the cabinet to facilitate disposal of the urine within the vessel.

In one aspect, the cabinet includes a shape of a rectangular prism.

In one aspect, at least one hinge is coupled to and between a sidewall and the door of the cabinet, the at least one hinge facilitating opening and closing of the door.

In one aspect, a latch is coupled to an interior surface of the door, the latch being configured to secure the door in a closed position.

In one aspect, a grab bar is coupled to the top wall or the sidewalls of the cabinet, the grab bar being tubular in shape.

In one aspect, the grab bar is positioned closer to the door than the rear wall.

In one aspect, the cabinet further includes a base compartment positioned adjacent the base of the cabinet, the base compartment being an open cavity defined by interior surfaces of the base, the sidewalls, the rear wall, and the door.

In one aspect, a rear wall support extends between and is coupled to the rear wall and the base.

In one aspect, the vessel is coupled to a shelf positioned within the cabinet.

In one aspect, the shelf is coupled to the sidewalls of the cabinet.

In one aspect, the shelf is coupled to a first slide and a second slide, the first and second slides being coupled to opposite sidewalls of the cabinet, and the first and second slides being configured to horizontally translate the shelf outward beyond the door of the cabinet.

In one aspect, a first shelf and a second shelf are positioned within the cabinet.

In one aspect, each of the first shelf and the second shelf are coupled to a first slide and a second slide, the first and second slides being coupled to opposite sidewalls of the cabinet, and the first and second slides being configured to horizontally translate the shelf outward beyond the door of the cabinet.

In one aspect, a first vessel is coupled to the first shelf and a second vessel is coupled to the second shelf.

In one aspect, the vessel is configured to be separately coupled to and decoupled from the first shelf and the second shelf.

In one aspect, the vessel is height adjustable relative to the base of the cabinet.

In one aspect, the vessel includes a non-splash attachment configured to reduce or eliminate splashing during urination, the non-splash attachment having a non-parallel and non-perpendicular angled surface relative to a lower surface of the vessel.

In one aspect, the vessel includes a seat on an upper surface of the vessel, such that the vessel is adapted for use by women.

In one aspect, the vessel contains a hydroscopic substance that absorbs the urine to further facilitate disposal.

In one aspect, the cabinet includes at least one bracket coupled to the sidewalls or the base of the cabinet, the at least one bracket being configured to secure the cabinet to a floor or other supporting surface.

LOG OF REFERENCE NUMERALS

10 Portable Urinal
12 Cabinet
14 Base
16 Top Wall
18 Rear Wall
20 Door
22 Sidewalls
24 Hinge
26 Handle
28 Latch
30 Grab Bar
32 Base Compartment
34 Bracket
36 Rear Wall Support
38 Vessel
40 Shelf
42 First Slide
44 Second Slide
46 Non-Splash Attachment
48 Non-Splash Feature

What is claimed is:

1. A portable urinal for use by people having limited mobility, the portable urinal comprising:

a cabinet having a base, a top wall, a rear wall, an openable and closeable door offset from the rear wall, and sidewalls extending from the base to the top wall and between the rear wall and the openable and closeable door; and a first vessel and a second vessel located within the cabinet, the first vessel and the second vessel each being configured to receive urine from a user and being removeable from the cabinet to facilitate disposal of the urine;

a bottom shelf coupled to the first vessel; and a top shelf coupled to the second vessel, wherein the bottom shelf and the top shelf are spaced apart vertically, with the bottom shelf being positioned for use while the user is in bed, and the top shelf being positioned for use while the user is standing up.

2. The portable urinal of claim 1, wherein each of the bottom shelf and the top shelf is coupled to the sidewalls of the cabinet.

3. The portable urinal of claim 1, wherein;

the bottom shelf is coupled to a first slide and a second slide, the first slide and the second slide are each coupled to opposite sidewalls of the cabinet, and the first slide and the second slides are configured to horizontally translate the bottom shelf outward beyond the openable and closeable door of the cabinet, and the top shelf is coupled to a third slide and a fourth slide, the third slide and the fourth slide are each coupled to opposite sidewalls of the cabinet, and the third slide and the fourth slide are configured to horizontally translate the top shelf outward beyond the openable and closeable door of the cabinet.

* * * * *